US007637293B2

(12) United States Patent
Hu

(10) Patent No.: US 7,637,293 B2
(45) Date of Patent: Dec. 29, 2009

(54) AUTOMATIC WOOD PLANER

(76) Inventor: Teng-Fu Hu, 6F., No. 146-21, Sec. 1, Dongshan Rd., Beitun District, Taichung City (TW)

( * ) Notice: Subject to any disclaimer, the term of this patent is extended or adjusted under 35 U.S.C. 154(b) by 118 days.

(21) Appl. No.: 12/098,218

(22) Filed: Apr. 4, 2008

(65) Prior Publication Data

US 2009/0223598 A1 Sep. 10, 2009

(30) Foreign Application Priority Data

Mar. 10, 2008 (TW) ..... 97204027 U

(51) Int. Cl.
*B27C 1/00* (2006.01)

(52) U.S. Cl. ..... 144/114.1; 144/117.1; 144/129

(58) Field of Classification Search ..... 144/114.1, 144/117.1, 129, 130, 136.95; 409/206
See application file for complete search history.

(56) References Cited

U.S. PATENT DOCUMENTS 4,064,920 A * 12/1977 Piche ..... 144/200
5,787,948 A * 8/1998 Fadyk ..... 144/130
7,000,658 B1 * 2/2006 Soukiassian et al. ..... 144/3.1

* cited by examiner

*Primary Examiner*—Shelley Self
(74) *Attorney, Agent, or Firm*—Egbert Law Offices PLLC

(57) ABSTRACT

The automatic wood planer includes two front columns separately assembled at both sides of the input end of the feed table of the main body. The pin joint end of the rotary support is screwed at the preset location of the feed table. The swinging end of the rotary support is connected to the lifting seat, so that the cutter shaft is assembled between the pin joint end of the rotary support and the swinging end. The present invention saves more components and reduces the volume and fabrication costs with improved economic efficiency and applicability.

6 Claims, 7 Drawing Sheets

AUTOMATIC WOOD PLANER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an automatic wood planer, and more particularly to an wood planer which enables the lift assembly of the cutter shaft to be implemented by adapting two front columns with two rotary supports.

2. Description of Related Art Including Information Disclosed Under 37 CFR 1.97 and 37 CFR 1.98.

An automatic wood planer is a woodworking machine used for automatically guiding, planing and leveling timber.

A typical automatic wood planer is formed in such a manner that the cutter shaft mechanism is assembled onto a preset location of a lifting footstock on the machine. The lifting footstock is supported by four columns at four corners, enabling it to slide along four columns when adjusting the planing height. However, it is found from actual application that the footstock of the automatic wood planer expands upward, thus bringing about a bulky and cumbersome structure. Moreover, higher fabrication costs and sales price impair its market competitiveness. From the perspective of mechanical operation of the typical automatic wood planer with four columns, screwing clearance exists between the columns and lifting rootstock, resulting in an obvious error during height adjustment of the lifting footstock.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

The present structure of two front columns and two rotary supports reduces the number of components and reduces the volume and fabrication costs, having improved economic efficiency and applicability.

With the improved structure, the screwing portion for adjustment of the cutter shaft will be reduced, resulting in little error and improved adjustment accuracy.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
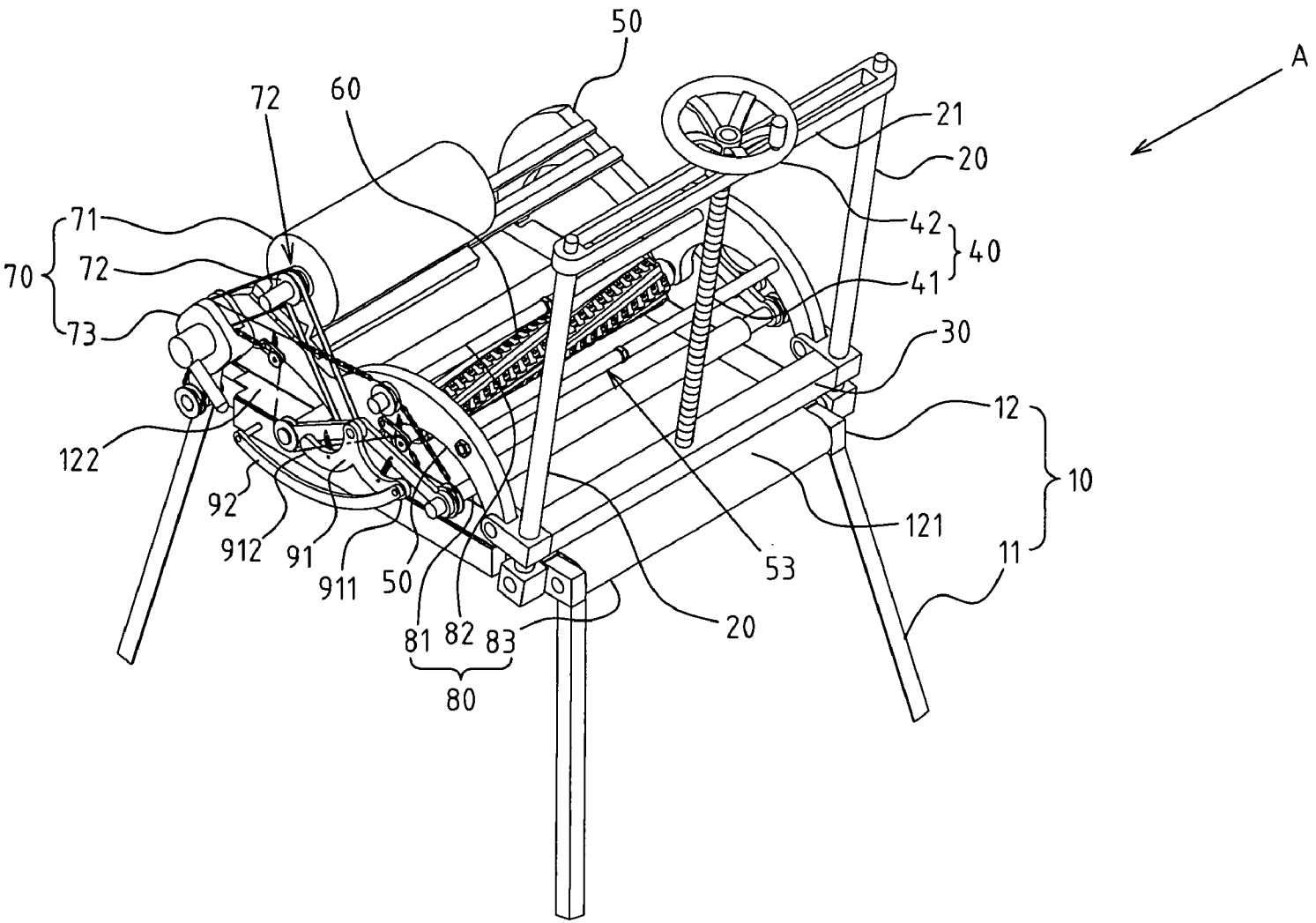
FIG. 1 shows an assembled perspective view of the present invention.
Figure 2:
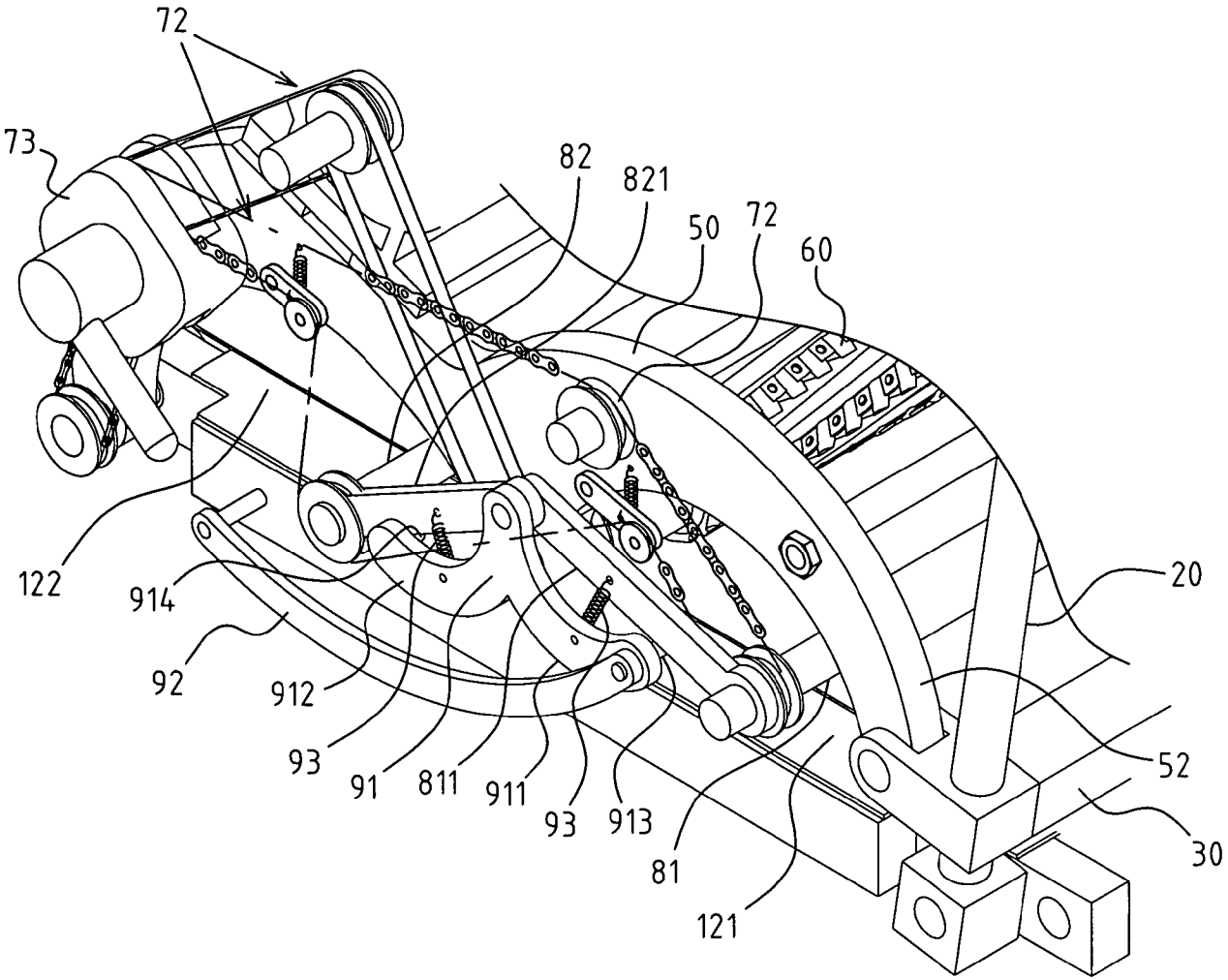
FIG. 2 shows a partially enlarged perspective view of the present invention.
Figure 3:
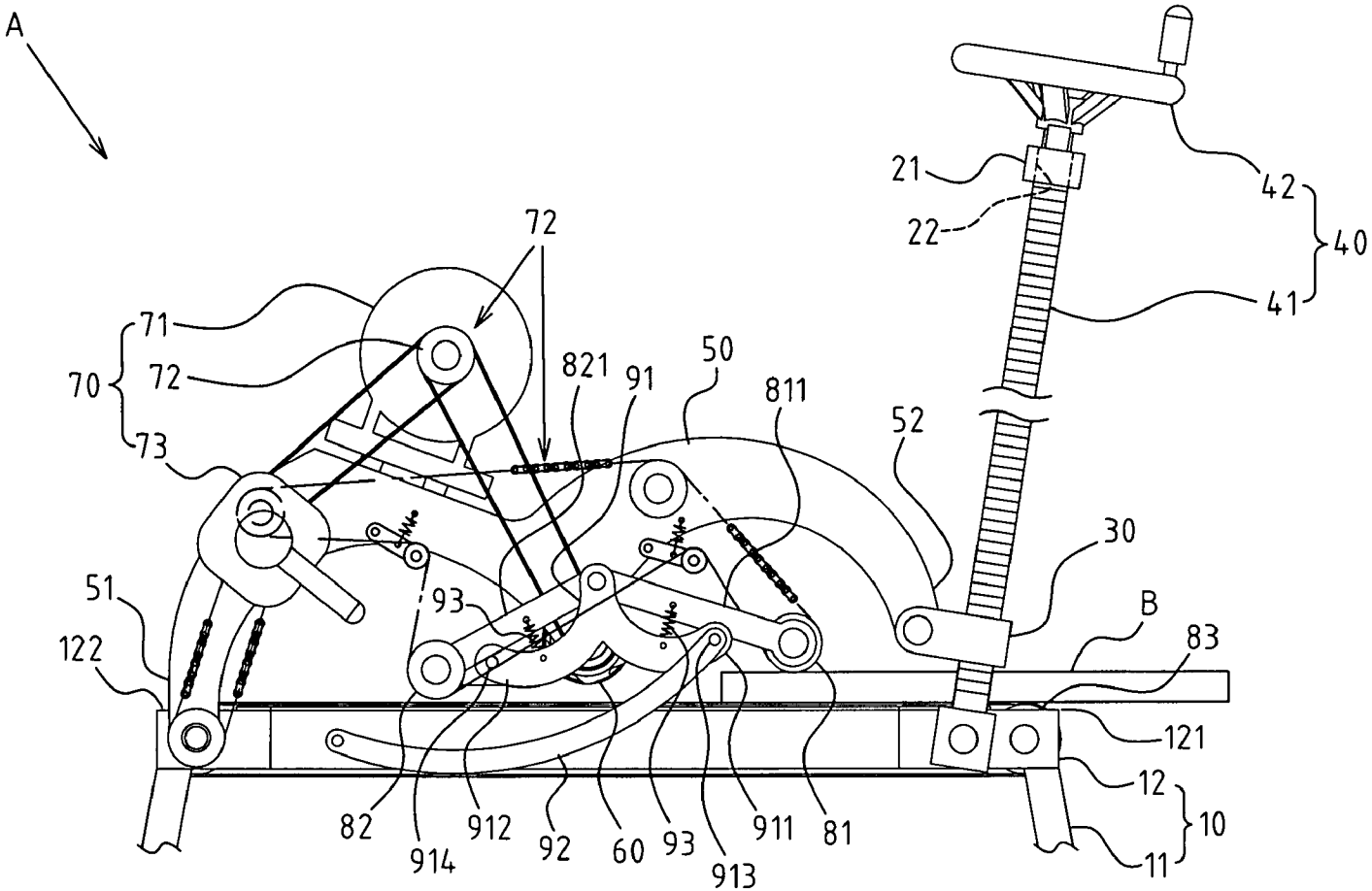
FIG. 3 shows a side elevation view of the planing operation of the present invention.

FIGS. 1-3 depict preferred embodiments of an automatic wood planer of the present invention. The embodiments are provided only for explanatory purposes with respect to the patent claims.

The automatic wood planer A comprises a main body 10, including a supporting portion 11 and feed table 12. The feed table 12 is provided with an input end 121 and an output end 122.

There are two front columns 20, arranged separately at both sides of input end 121 of the feed table 12 of the main body 10. The bottom of two front columns 20 is screwed with the feed table 12 for a swinging state, and the top of two front columns 20 is connected via a cross bracket 21.

A lifting seat 30 transversely bridges between two front columns 20 in a sliding state.

A brake unit 40 controls the sliding state of the lifting seat 30.

Two rotary supports 50 are obliquely assembled between the lifting seat 30 and the output end 122 of the feed table 12. The rotary support 50 is available with pin joint end 51, which could be screwed at both sides of the output end 122 of the feed table 12, or screwed on the protruding framework of the feed table 12. The other end of the rotary support 50 is a swinging end 52 connected at both sides of the lifting seat 30. The rotary support 50 is also of a prefabricated structure.

A cutter shaft 60 is assembled at a central section between pin joint end 51 and swinging end 52 of two rotary supports 50, so that the bottom of the cutter shaft 60 is placed opposite to the feed table 12.

A brake unit 70 of the cutter shaft 60 is used to drive the cutter shaft 60 for rotation.

A feed unit 80 includes at least a front roller 81 and a rear roller 82, which are separately assembled at the bottom of the rotary support 50. The rollers 81, 82 are transversely positioned at intervals with the cutter shaft 60.

The brake unit 40 comprises a screw 41 and a rotary table 42 fixed onto top of the screw 41. Then, the cross bracket 21 at the tops of two front columns 20 is provided with a screw hole 22 (shown in FIG. 3) for the screw 41. The bottom of the screw 41 is rotatably connected to the lifting seat 30, so the rotary table 42 could be operated to drive the forward and reverse rotation of the screw 41, thus enabling the sliding of the lifting seat 30.

The cutter shaft's brake unit 70 comprises a motor 71, drive unit 72 (belt and belt wheel, or chain and chain wheel) and a gearbox 73. The motor 71 is assembled at the top of two rotary supports 50 adjacent to the pin joint end 51. The drive unit 72 is placed laterally onto the rotary support 50, and then connected with the motor 71, cutter shaft 60 and front and rear rollers 81, 82, so the motor 71 simultaneously drives the cutter shaft 60 and front/rear rollers 81, 82. The feedstock could be shifted with forward drive of the front and rear rollers 81, 82. Moreover, said feed unit 80 comprises a conveyor belt 83, which is assembled onto the feed table 12 for recycling operations. The conveyor belt 83 could also be driven by the cutter shaft's brake unit 70. Additionally, the feed unit 80 drives the feedstock forward via the conveyor belt 83. In such a case, the front and rear rollers 81, 82 just press the feedstock without being driven by the cutter shaft's brake unit 70. (Note: this view shows that the front and rear rollers 81, 82 and conveyor belt 83 are driven by the cutter shaft's brake unit 70 simultaneously).

A swinging rack 91 and traction frame 92 are arranged between the swinging end 52 of two rotary supports 50 and the feed table 12. The swinging rack 91 is provided with front and rear extensions 911, 912, which are available with stoppers 913, 914. Both ends of the traction frame 92 are separately connected to the front extension 911 of the swinging rack 91 and the feed table 12, so that the front and rear rollers 81, 82 are separately adapted with the rotary support 50 and swinging rack 91 via front and rear cantilever 811, 821. The front and rear cantilevers 811, 821 are separately supported on the stopper 913, 914 of the front and rear extension 911, 912 of the swinging rack 91. Furthermore, an elastic member 93 (a spring) is arranged between the front and rear extensions 911, 912 and front and rear cantilevers 811, 821.

Figure 6:
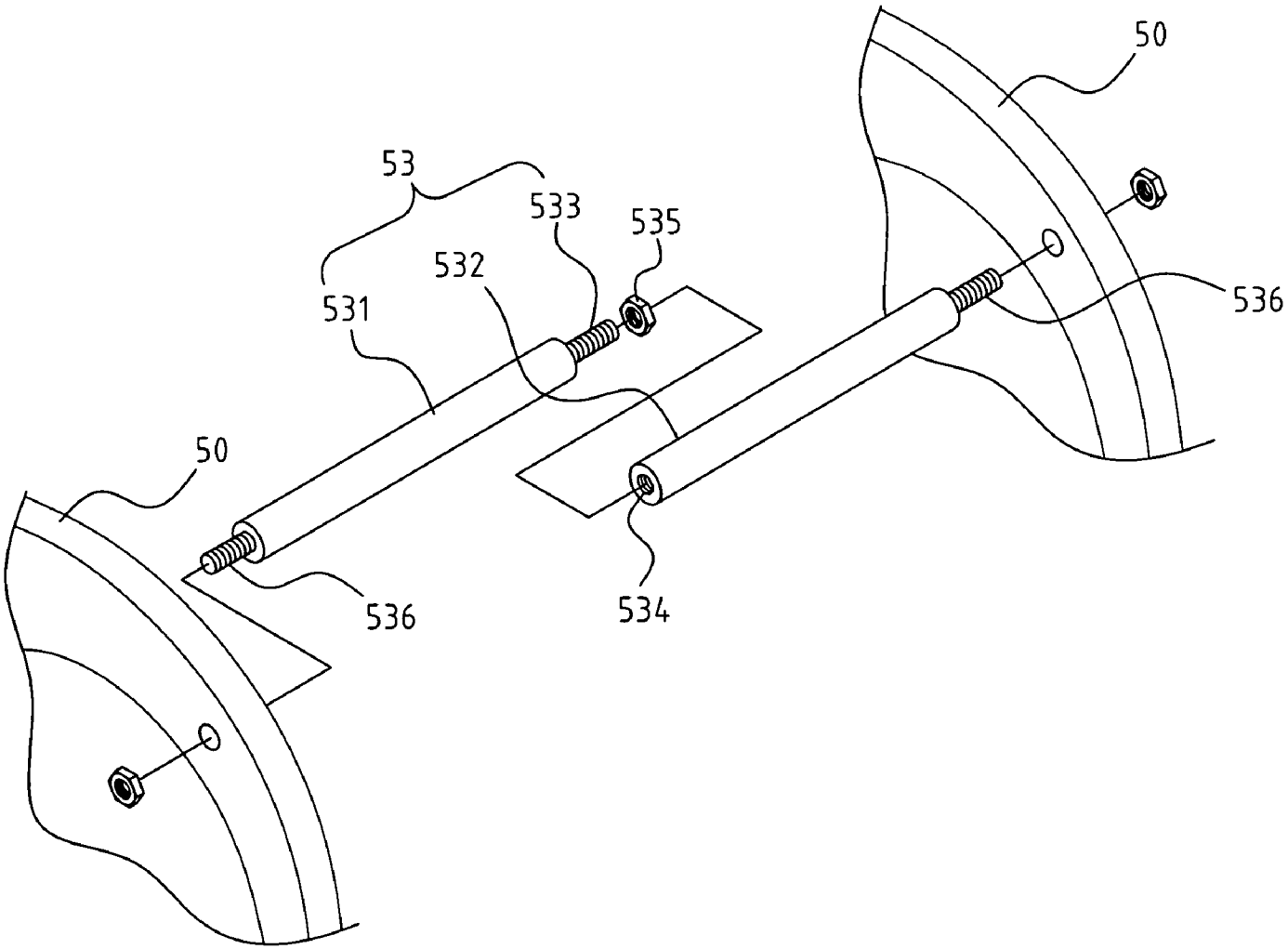
FIG. 6 shows an exploded perspective view of the reinforced rod of the present invention.
Figure 7:
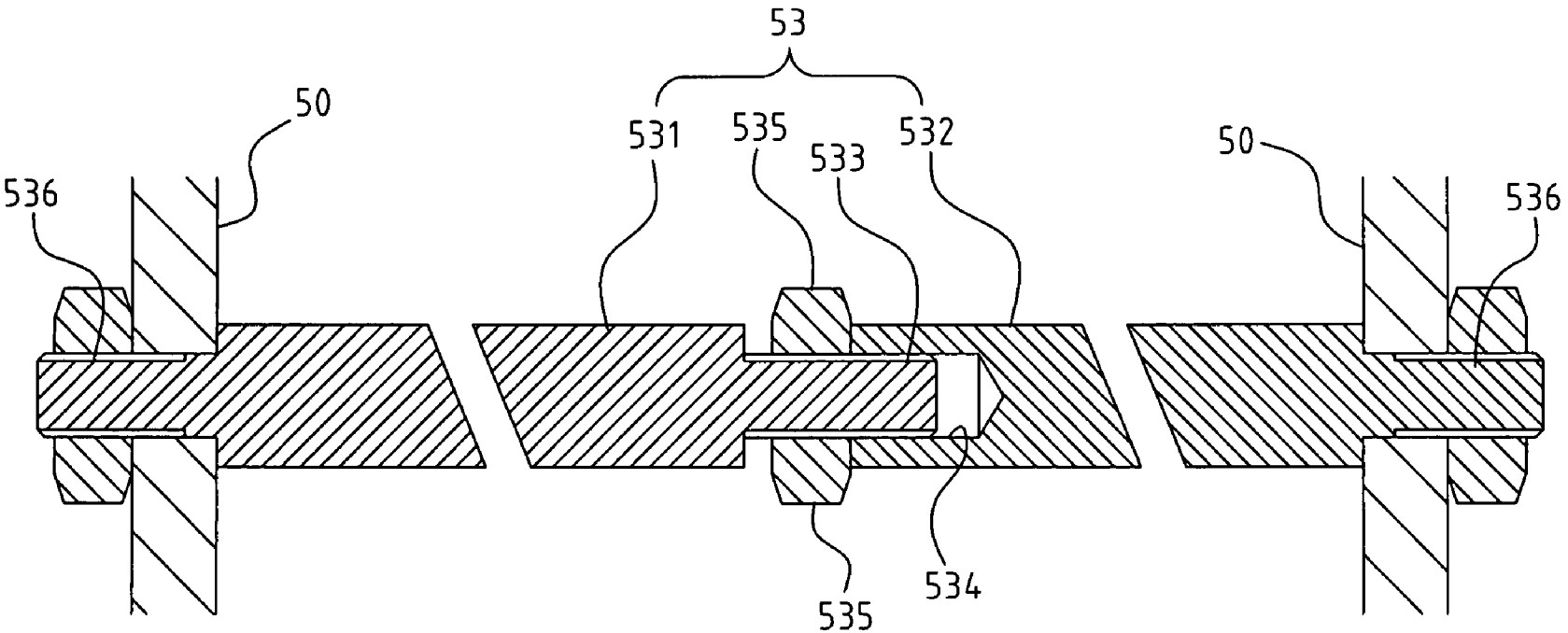
FIG. 7 shows an assembled sectional view of reinforced rod of the present invention.

A plurality of reinforced rods 53 is arranged between two rotary supports 50. Referring to FIGS. 6 and 7, the reinforced rod 53 comprises the first and second rods 531, 532, where stud 533 and screw hole 534 are arranged at the coupling end of the first and second rods 531, 532. The stud 533 is provided with nut 535, while the stud 536 is placed externally onto the first and second rods 531, 532, and located via the nut onto two rotary supports 50; the reinforced rod 53 is used to make up the spacing error between two rotary supports 50 since the coupling portion allows for slight adjustment of the length, helping to realize optimum connection and reinforcement.

Figure 4:
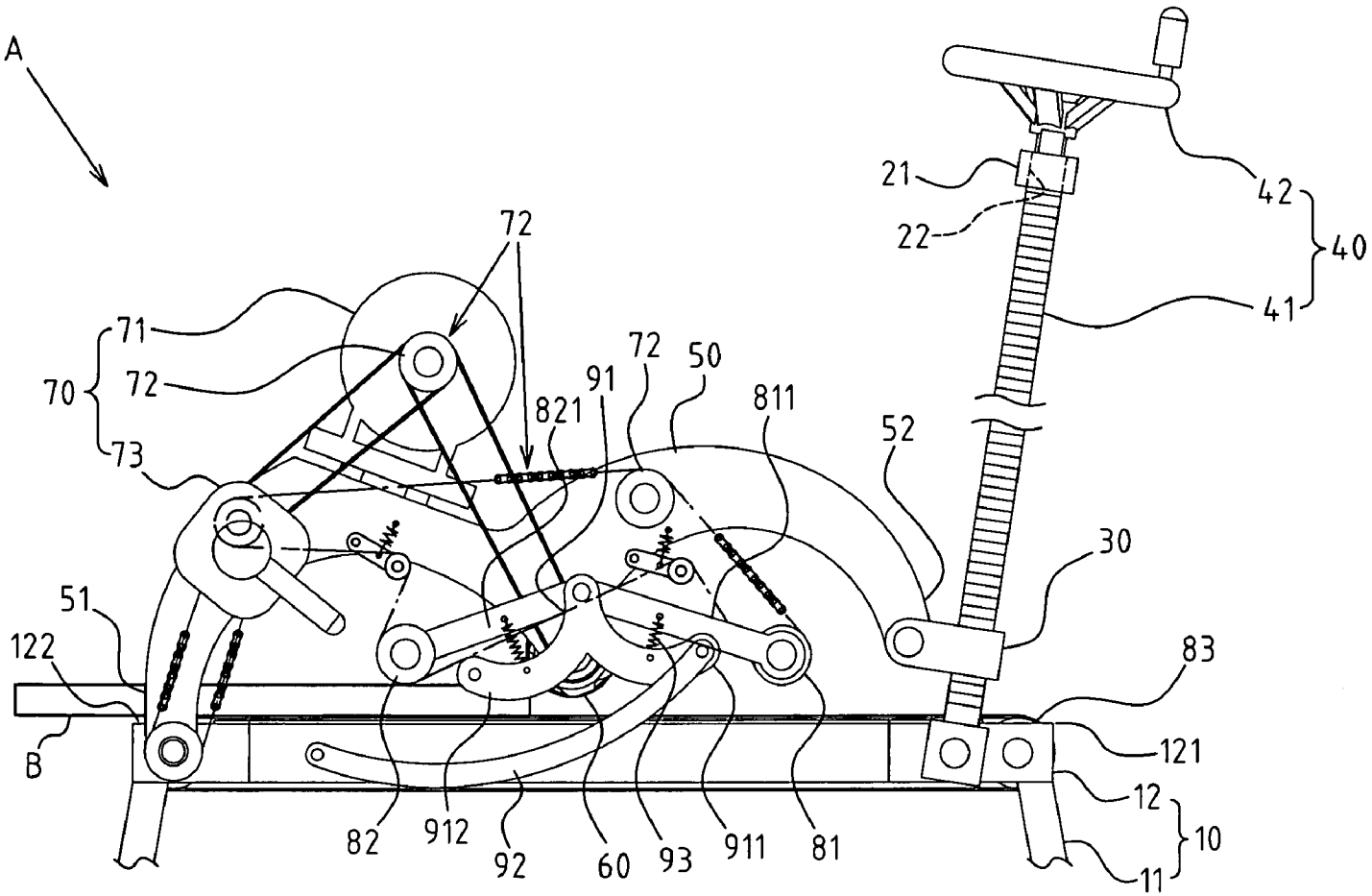
FIG. 4 shows another side elevation view of the planing operation of the present invention.
Figure 5:
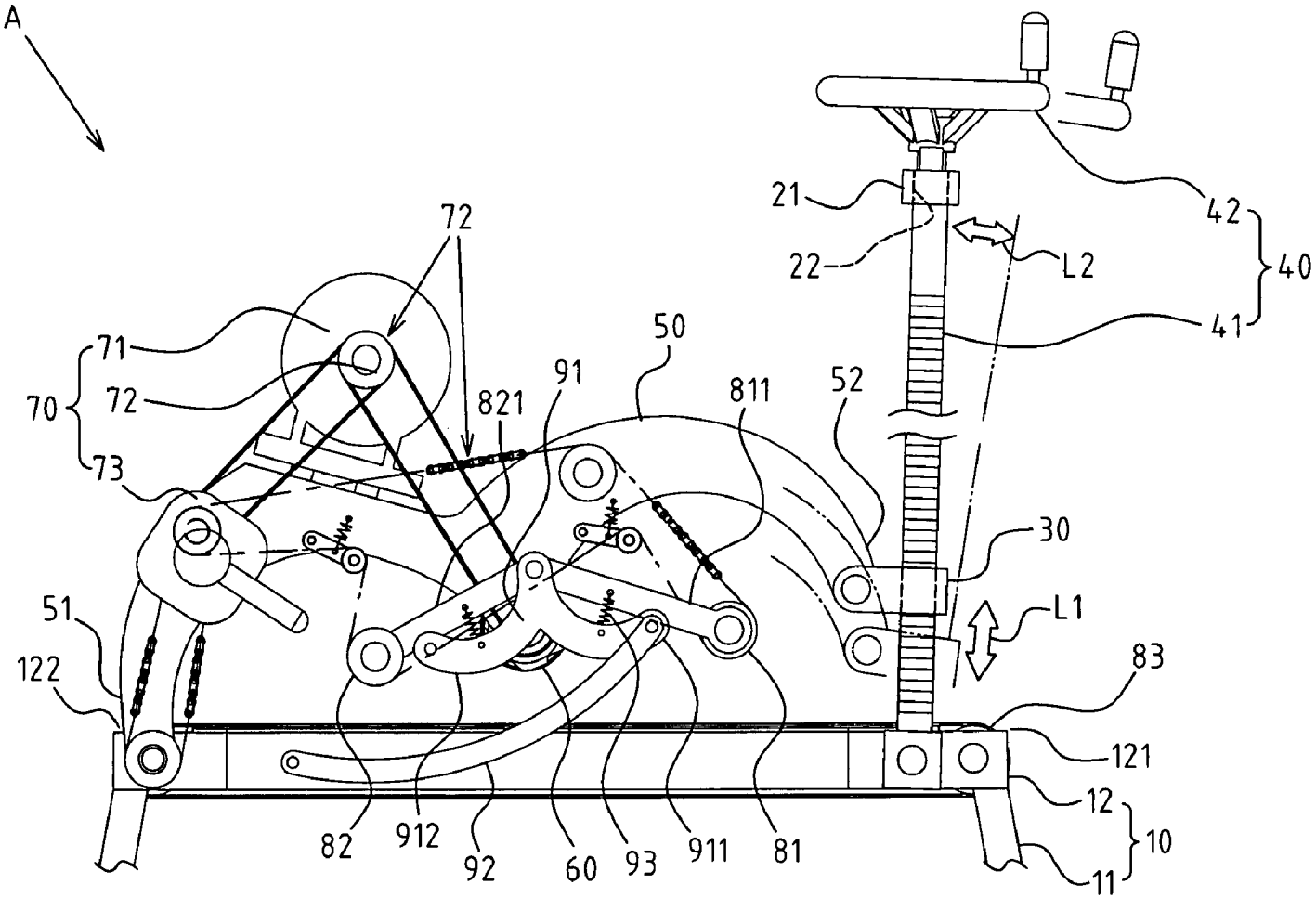
FIG. 5 shows a side elevation view of the height adjustment of a cutter shaft of the present invention.

Based upon above-specified structures, the present invention operates as follows:

Referring to FIGS. 4 and 5, when it is intended to adjust the height of said cutter shaft 60, the rotary table 42 of the brake unit 40 rotates forward or backward. The rotation of the rotary table 42 will drive the screw 41 to pass through the screw hole 22 of the cross bracket 21, so the motion of screw 41 will lead to a vertical shift, and then will drive the lifting seat 30 to slide along two front columns 20 (shown by arrow L1). With the slide of the lifting seat 30, the swinging end 52 of two rotary supports 50 will be driven for vertical swinging. The cutter shaft 60 between pin joint end 51 and swinging end 52 of two rotary supports 50 flexibly lifts for adjusting the planing depth. Moreover, when the lifting seat 30 is activated to drive the rotary support 50 for oblique swinging, the swinging end 52 will generate lateral displacement. Correspondingly, a swinging structure may be designed between the bottom of two front columns 20 and the feed table 12, allowing for smooth motion of the lifting seat 30.

On the other hand, the traction frame 92 and swinging rack 91 are arranged to make the front and rear rollers 81, 82 press horizontally against the feedstock during oblique swinging of two rotary supports 50. Referring to FIG. 5, when the swinging end 52 of the rotary support 50 is driven by the lifting seat 30 to shift upward, both ends of the traction frame 92 are separately connected to the front extension 911 of the swinging rack 91 and the feed table 12. The front and rear rollers 81, 82 press horizontally against the feedstock without being affected by the oblique swinging of the rotary support 50 (since the front and rear cantilevers 811, 821 of front and rear rollers 81, 82 are supported by the front and rear extensions 911, 912 of the swinging rack 91, and the front and rear extensions 911, 912 are connected to the front and rear cantilevers 811, 821 via an elastic member 93).

Referring to FIGS. 3 and 4, feedstock B is fed from the input end 121 of the feed table 12, then guided and rolled through the conveyor belt 83 and front roller 81 of the feed unit 80, enabling the smooth planning of the cutter shaft 60. Then, the feedstock B will be rolled by the rear roller 82 and output via the conveyor belt 83 outside of the feed table 12.

I claim:

1. An automatic wood planer, comprising:

a main body, being comprised of a supporting portion and feed table, said feed table having an input end and an output end;

two front columns, arranged separately at both sides of said input end, said two front columns having bottoms screwed to said feed table in a swinging position, said two front columns having tops connected via a cross bracket;

a lifting seat, transversely bridged between said two front columns in a slidable position, said lifting seat having a brake unit positioned to set said slidable position of said lifting seat;

a plurality of rotary supports, obliquely assembled between said lifting seat and said output end of said feed table, each rotary support being available with a pin joint end in screwing engagement at a preset location of the feed table and another end being a swinging end connected to said lifting seat;

a cutter shaft, assembled at a central section between said pin joint end and said swinging end of two rotary supports, said cutter shaft having a bottom placed opposite to said feed table, said cutter shaft having a brake unit in driving relation to said cutter shaft for rotation of said cutter shaft; and a feed unit, being comprised of a front roller and a rear roller, the rollers being separately assembled at said bottom of said rotary support and transversely positioned at intervals with the cutter shaft.

2. The automatic wood planer defined in claim 1, wherein said brake unit of said lifting seat comprises a screw and a rotary table fixed onto top of said screw, said cross bracket at a top of two front columns being provided with a screw hole for engagement with said screw, said screw having a bottom rotatably connected to said lifting seat, said rotary table driving rotation of said screw, enabling said slidable position of said lifting seat.

3. The automatic wood planer defined in claim 1, wherein said brake unit of said cutter shaft comprises a motor, drive unit and a gearbox, said motor being assembled at said tops of said two rotary supports, said drive unit being placed laterally onto said rotary support and connected to said motor, cutter shaft and front and rear rollers.

4. The automatic wood planer defined in claim 1, wherein said feed unit comprises a conveyor belt, assembled onto said feed table and driven by said brake unit of said cutter shaft simultaneously.

5. The automatic wood planer defined in claim 1, further comprising:

a swinging rack and traction frame arranged between said swinging end of said two rotary supports and said feed table, said swinging rack being provided with front and rear extensions with stoppers, both ends of said traction frame being separately connected to a front extension of said swinging rack and said feed table, the front and rear rollers being separately adapted to said rotary support and said swinging rack via front and rear cantilevers, said front and rear cantilevers being separately supported on a stopper of the front and rear extension of said swinging rack, an elastic member being arranged between the front and rear extensions and said front and rear cantilevers.

6. The automatic wood planer defined in claim 1, wherein said rotary supports are arranged at intervals, and have a plurality of reinforced rods arranged between said rotary supports, each reinforced rod comprising first and second rods, a stud and a screw hole, said stud being provided with a nut and being placed externally onto said first and second rods, positioning onto said two rotary supports.

* * * * *